US011731445B2

(12) United States Patent
Warwick

(10) Patent No.: US 11,731,445 B2
(45) Date of Patent: Aug. 22, 2023

(54) LASER MARKING WARPAGE MITIGATION

(71) Applicant: Entrust Datacard Corporation, Shakopee, MN (US)

(72) Inventor: Denny Warwick, Shakopee, MN (US)

(73) Assignee: ENTRUST CORPORATION, Shakopee, MN (US)

( * ) Notice: Subject to any disclaimer, the term of this patent is extended or adjusted under 35 U.S.C. 154(b) by 0 days.

(21) Appl. No.: 16/784,893

(22) Filed: Feb. 7, 2020

(65) Prior Publication Data

US 2020/0254804 A1 Aug. 13, 2020

Related U.S. Application Data

(60) Provisional application No. 62/802,872, filed on Feb. 8, 2019.

(51) Int. Cl.

| | |
|---|---|
| ***B41M 5/26*** | (2006.01) |
| ***B42D 25/435*** | (2014.01) |
| ***B42D 25/23*** | (2014.01) |
| ***B42D 25/41*** | (2014.01) |
| ***B42D 25/485*** | (2014.01) |

(52) U.S. Cl.

CPC ..... *B41M 5/267* (2013.01); *B42D 25/435* (2014.10)

(58) Field of Classification Search

CPC ..... B41M 5/267; B42D 25/435; B42D 25/23; B42D 25/41; B42D 25/485

USPC ..... 283/67, 70, 72, 74, 75, 77, 86, 94, 98, 283/901

See application file for complete search history.

(56) References Cited

U.S. PATENT DOCUMENTS

| | | | |
|---|---|---|---|
| 4,825,054 | A | 4/1989 | Rust et al. |
| 5,266,781 | A | 11/1993 | Warwick et al. |
| 5,943,238 | A | 8/1999 | Nioche et al. |
| 6,160,603 | A | 12/2000 | Tanaka et al. |
| 6,695,205 | B1 | 2/2004 | Lundstrom et al. |
| 6,783,067 | B2 | 8/2004 | Kreuter et al. |
| 6,902,107 | B2 | 6/2005 | Shay et al. |
| 7,398,972 | B2 | 7/2008 | Schuller et al. |
| 7,434,728 | B2 | 10/2008 | Paulson et al. |

(Continued)

FOREIGN PATENT DOCUMENTS

| | | |
|---|---|---|
| EP | 0893191 A1 | 1/1999 |
| EP | 1834795 A1 | 9/2007 |

(Continued)

OTHER PUBLICATIONS

International Search Report and Written Opinion, International Patent Application No. PCT/IB2020/050991, dated Feb. 7, 2020 (11 pages).

(Continued)

*Primary Examiner* — Justin V Lewis

(74) *Attorney, Agent, or Firm* — Hamre, Schumann, Mueller & Larson, P.C.

(57) ABSTRACT

Techniques are described herein that mitigate warpage during laser marking on a plastic security document. A method of laser marking a feature onto a plastic card includes electronically dividing an image of the feature into a plurality of sections. The method includes laser marking a first one of the sections on the document and laser marking a second one of the sections on the document. The first section is not contiguous with the second section.

21 Claims, 14 Drawing Sheets

(56) References Cited

U.S. PATENT DOCUMENTS

| | | | | |
|---|---|---|---|---|
| 2003/0183695 | A1* | 10/2003 | Labrec | G06K 19/10 235/487 |
| 2007/0051583 | A1 | 3/2007 | Heinrich | |
| 2012/0126525 | A1* | 5/2012 | Dorfler | B42D 25/41 347/240 |
| 2013/0175793 | A1* | 7/2013 | Mercier | B42D 25/29 283/74 |
| 2014/0078234 | A1 | 3/2014 | Kawahara et al. | |
| 2015/0049154 | A1 | 2/2015 | Oda | |
| 2015/0146297 | A1* | 5/2015 | Commander | B42D 25/342 359/627 |

FOREIGN PATENT DOCUMENTS

| | | | |
|---|---|---|---|
| WO | 2010-011227 | A1 | 1/2010 |
| WO | 2011/124920 | A1 | 10/2011 |

OTHER PUBLICATIONS

Extended European Search Report, European Patent Application No. 20752734.2, dated Oct. 13, 2022 ( 9 pages).

* cited by examiner

Lasing Sequences a. 1-8-2-7-3-6-4-5
b. 8-1-7-2-6-3-5-4

Lasing Sequences a. 1-8-2-7-3-6-4-5
b. 1-7-2-8-3-5-4-6
c. 2-7-1-8-4-5-3-6
d. 2-8-1-7-4-6-3-5
e. 7-1-8-2-5-3-6-4
f. 8-2-7-1-6-4-5-3
g. 8-1-7-2-6-3-5-4
h. 7-2-8-1-5-4-6-3

Completed image

LASER MARKING WARPAGE MITIGATION

FIELD

This description relates to laser marking plastic security documents such as plastic cards that include financial (e.g., credit, debit, or the like) cards, driver's licenses, national identification cards, business identification cards, gift cards, and other plastic cards, as well as plastic passport pages. The security documents typically bear personalized data unique to the intended security document holder and/or which bear other information unique to these types of plastic security documents.

BACKGROUND

The use of a laser to apply markings to plastic cards is known in the art of plastic security document personalization. In some applications, very close registration (i.e., specific alignment of markings) may be required between preprinted or other information previously applied on the plastic security document and subsequently applied laser marking(s). However, the heat generated by the laser on the document surface can cause warpage (i.e. distortion) of the document surface contacted by the laser.

During laser marking, heat is generated near the surface of the document. The heat causes the material of the plastic security document to expand, and for higher power laser marking that is generally used to achieve dark black results, very small microscopic bubbles can form in the plastic material. After the laser moves to a new portion of the surface, the portion just contacted by the laser cools. However, the bubbles remain inside the material thereby preventing the surface from fully returning to its former substantially flat or substantially planar state and a small amount of permanent warpage will remain. Such warpage can cause subsequently applied laser markings to be displaced from their intended locations on the document surface.

FIG. 1 illustrates an example of warpage 10 that can occur on a surface 12 of a plastic security document 14. For simplicity in explaining the problem, the warpage 10 is illustrated as being approximated by a circular arc with radius R. However, the warpage 10 may not be an arc, and the warpage 10 may not be uniform. The unwarped surface 12 is indicated by dashed line. The line 16 shows the position 18*a* of optional preprint information at the original flat condition of the surface 12 and the position 18*b* of the optional preprint information on the warpage 10. The warping 10 shifts the position 18*b* by a distance D. The laser system (not visible) aims to apply a laser beam 20 at the original position 18*a* in the flat condition, but due to the warpage 10 the laser beam 20 will now actually apply laser marking at location 22 on the surface of warpage 10. At this location 22, the laser marking is now offset by distance, D'. In the example shown in FIG. 1, the laser beam 20 is not at 90 degrees to the surface 12 which increases the offset D' amount. The positional offset D caused by the warpage 10 will be zero (0) along the centerline C and zero (0) at the edges of the warpage 10 where the warpage 10 intersects the flat surface 12.

SUMMARY

Techniques are described herein that mitigate warpage during laser marking on a plastic security document. By mitigating warpage, the resulting placements of the laser markings on the card are more accurate and closer to the intended marking locations. Warpage is mitigated by applying the laser energy to the document in such a way that any resulting warpage is minimized or prevented, while still generating the laser marking(s) in a more or less continuous flow of the laser marking. In one non-limiting example, warpage mitigation is achieved by altering the sequence in which laser markings are applied to the document. In an embodiment, a time delay can be added between each application of the laser beam to the document to help mitigate warpage. In an embodiment, the sequence of laser application can be altered and a time delay can be added to help mitigate warpage.

The term "warpage" as used herein refers to distortion of the document caused by application of the laser to the document, where the heat generated by the laser causes distortion of the document. The distortion of the document is typically permanent (i.e. the document remains distorted after application of the laser thereto, although the degree of distortion may reduce upon cooling from an initial maximum distorted condition). The distortion can be on a surface of the document, and the surface can be an external surface of the document or an internal surface of the document, for example on a surface of an internal layer of the document.

The term "plastic security document" is intended to include, but is not limited to, plastic cards such as financial (e.g., credit, debit, or the like) cards, driver's licenses, national identification cards, business identification cards, gift cards, and other plastic cards, as well as plastic passport pages. The security documents typically bear personalized data unique to the intended security document holder and/or which bear other information unique to these types of plastic security documents.

In one specific non-limiting application of the techniques described herein, the laser markings may be registered with previously applied feature(s) on the plastic security document. The previously applied feature may be one or more printed features, a hologram, or other applied feature with which one may want to register laser markings with. The warpage mitigation techniques described herein improve the registration between the laser markings and the previously applied information on the document.

A method of laser marking a feature onto a plastic card is also described. The method includes laser marking a first portion of the feature onto the plastic card. The method further includes laser marking a second portion of the feature onto the plastic card. The first portion is not contiguous with the second portion.

A method of laser marking a feature onto a plastic card is also described. The method includes electronically dividing an image of the feature into a plurality of sections. The method includes laser marking a first one of the sections on the plastic card and laser marking a second one of the sections on the plastic card. The first section is not contiguous with the second section.

A plastic card processing system is also disclosed. The system includes a card input that holds a plurality of plastic cards to be laser marked. A laser system applies a laser beam to the plurality of plastic cards. A card output collects plastic cards that have been laser marked. A transport mechanism transports the plurality of plastic cards from the card input, to the laser system, and to the card output. A controller electronically divides an image of a feature into a plurality of sections, laser marks a first one of the sections on one of the cards using the laser system, and laser marks a second one of the sections on the one card using the laser system. The first section is not contiguous with the second section.

A method of laser marking a feature onto a plastic card is also disclosed. The method includes laser marking a first portion of the feature onto the plastic card in a first direction that is from a first terminal edge of the feature toward a center of the feature. The method includes laser marking a second portion of the feature onto the plastic card in a second direction that is from a second terminal edge of the feature toward the center of the feature.

A method of laser marking a feature onto a plastic card is also disclosed. The method includes laser marking a first portion of the feature onto the plastic card. A second portion of the feature is laser marked onto the plastic card, the second portion being spaced from the first portion. The method further includes laser marking a third portion of the feature onto the plastic card, the third portion being adjacent the first portion.

DRAWINGS

Figure 1:
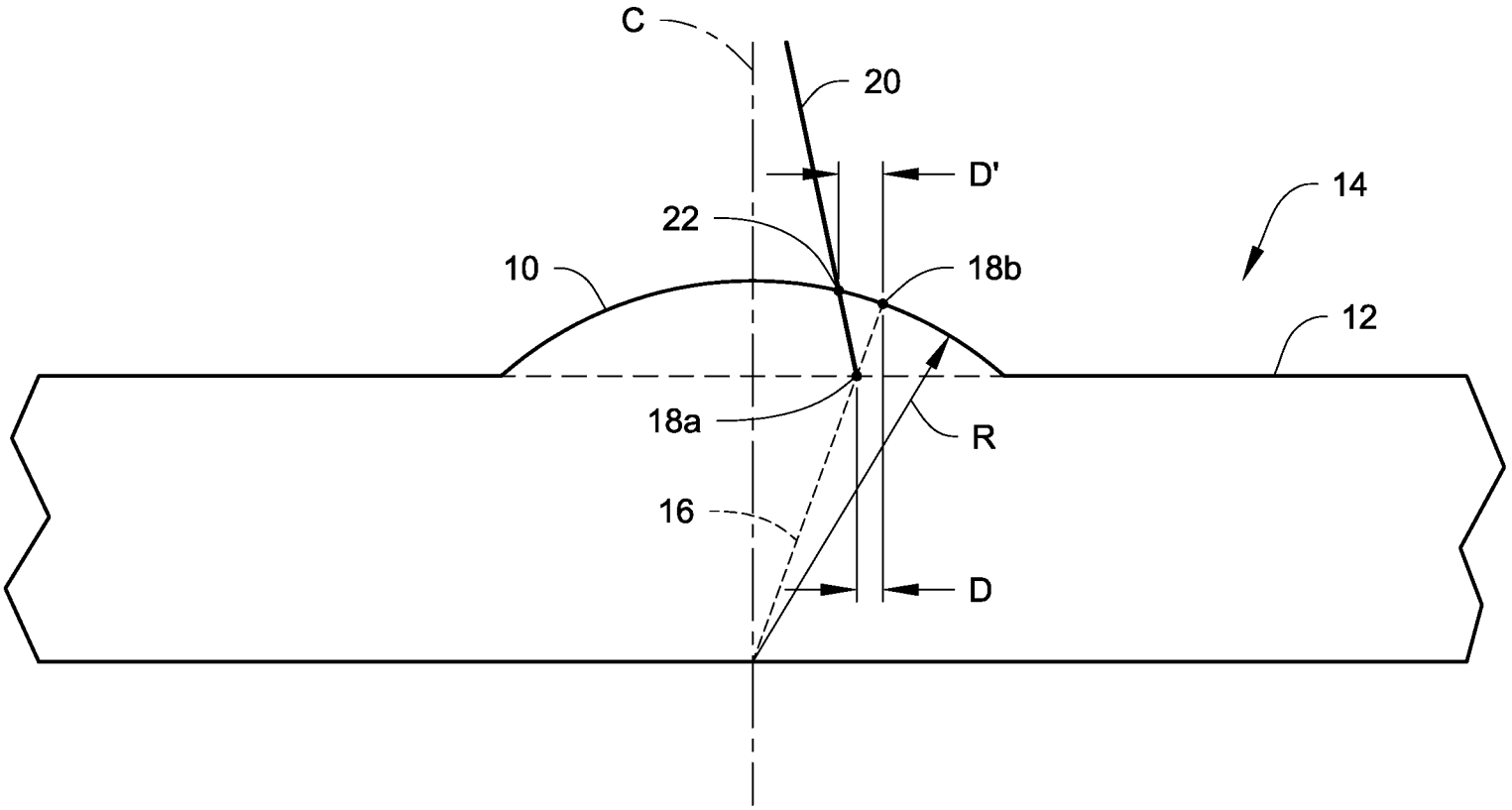
Fig. 1 (Prior Art)
FIG. 1 illustrates a prior art example of warpage that can occur on a plastic card as a result of laser marking.

FIGS. 10A-F illustrates an example of a method of laser marking a feature onto the document.

DETAILED DESCRIPTION

Warpage mitigation techniques during laser marking on a plastic security document are described herein. By mitigating warpage, the resulting placement of the laser markings on the document is more accurate and closer to the intended marking locations. In one non-limiting example described in detail below, warpage mitigation is achieved by altering the sequence in which laser markings are applied to the document, compared to the traditional or regular technique of applying laser markings. In an embodiment, a time delay can be added between each application of the laser beam to the document to help mitigate warpage. In an embodiment, both the sequence of laser application can be altered and a time delay can be added to help mitigate warpage.

The term "plastic security document" as used herein is intended to encompass plastic security documents that are personalized for (i.e. data is added to the document that is specific or unique to) a specific intended document holder. An example of one type of a plastic security document includes plastic cards that are completely or substantially plastic, as well as cards that have non-plastic or composite components and cards having other formulations that function like the card types indicated above. Another example of a type of plastic security document is a page of a passport. Plastic security documents can be made of one or more plastic materials including, but not limited to, polycarbonate (PC) or polyvinyl chloride (PVC).

Cards that are encompassed by the term "plastic cards" often bear printed personalized data unique to or assigned specifically to the cardholder, such as the name of the cardholder, an account number, an image of the face of the cardholder, and other data. The plastic card may also have an integrated circuit chip that stores data relating to the card and/or a magnetic stripe that stores data relating to the card. Similarly, a plastic passport page may bear printed personalized data unique to or assigned specifically to the intended passport holder, such as the name of the passport holder, a passport number, an image of the face of the passport holder, and other data. The passport page may also have an integrated circuit chip that stores data relating to the passport and/or a magnetic stripe that stores data relating to the passport.

In one embodiment, the plastic card can be a plastic identification card. An identification card typically has at least a cardholder name, and a printed image of at least the face of the intended cardholder. The identification card may also have an integrated circuit chip that stores data relating to the card and/or a magnetic stripe that stores data relating to the card.

To facilitate describing the concepts herein, the following description will describe the plastic security document as being a plastic card, in particular a plastic identification card. However, the concepts described herein can be applied to other types of plastic cards, as well as to plastic passport pages and other plastic security documents.

The following description may also describe the laser marking occurring on a surface of the plastic card. The surface can be an external or outer surface of the plastic card or an internal or interior surface (at a level below the external or outer surface) of the plastic card, for example on a surface of an internal layer of the plastic card.

Figure 2:
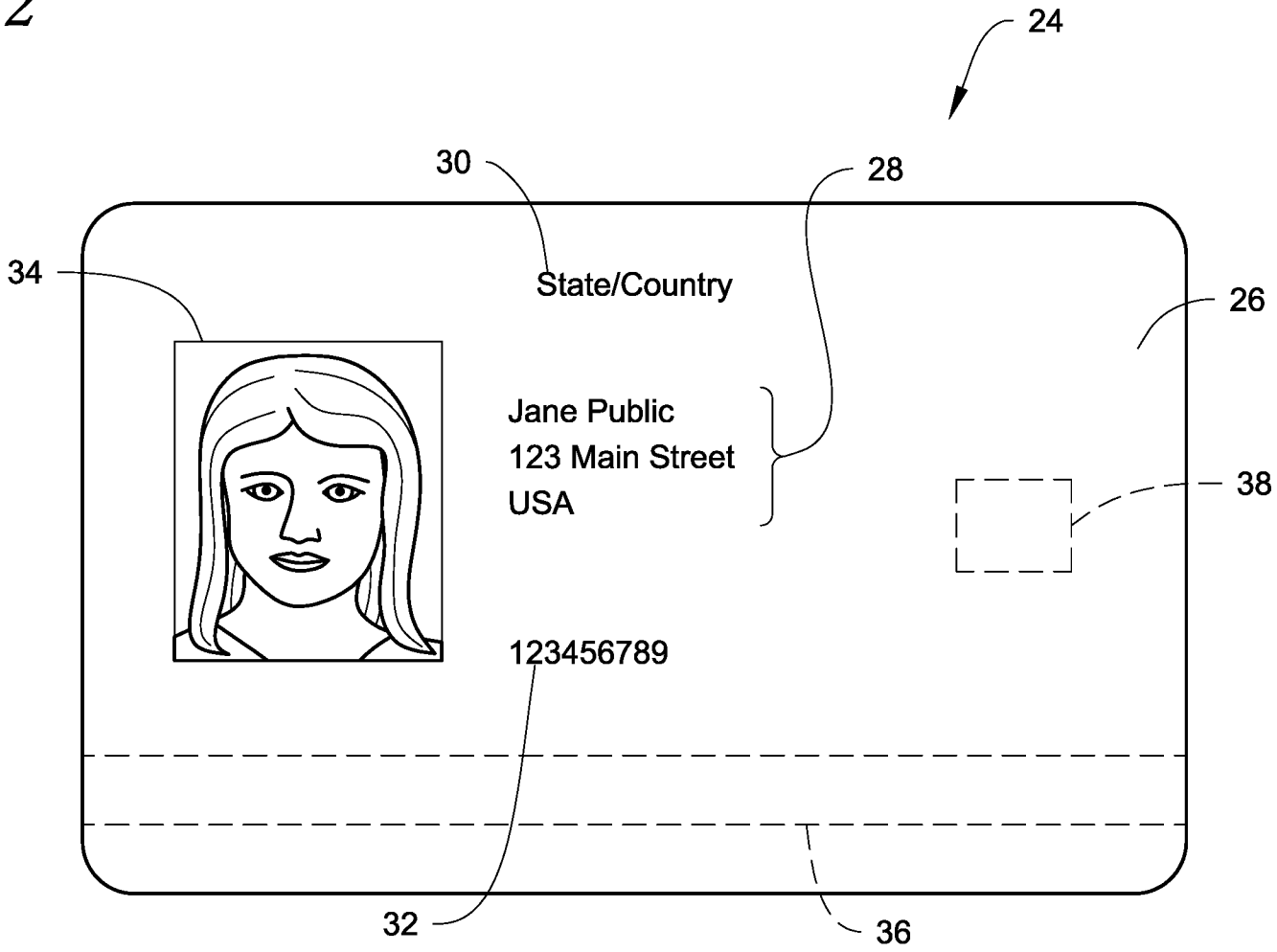
FIG. 2 illustrates an example of a plastic security document in the form of a plastic card with laser markings applied thereto.

FIG. 2 illustrates an example of a plastic identification card 24 having a front surface 26. Many different layouts for the front surface 26 are possible. For example, the front surface 26 can include a horizontal card layout, a vertical card layout, and other known layout configurations and orientations. The front surface 26 can include printed or embossed cardholder data 28 such as the cardholder name and address. The front surface 26 may also include a printed or embossed indicator 30 of the state or country (or other government entity) that issued the card 24, as well as a printed or embossed identification number 32. Other elements such as printed graphics (not shown) and a hologram (not shown) may be present on the front surface 26. The front surface 26 also includes a printed image 34 of the intended cardholder.

The card 24 also includes a back surface 27 (best seen in FIG. 3) that can also include many possible layouts, which may or may not have a similar layout as the front surface 26. For example, the back surface can include a horizontal card layout, a vertical card layout, and other known layout configurations and orientations. The back surface 27 can also include an optional magnetic stripe 36 (illustrated in dashed line in FIG. 2) that stores various data relating to the card 24 such as the identification number and/or the name of the cardholder, as well as possibly a signature panel that provides a place for the cardholder to sign their name. The magnetic stripe 36 and the signature panel are conventional elements found on many plastic cards.

The card 24 can also optionally include an integrated circuit chip 38 (illustrated in dashed lines in FIG. 2) that stores data relating to the card 24.

Any one or more of the cardholder data 28, the indicator 30, the identification number 32, and the image 34 may be printed. The term "printed" or the like as used herein encompasses printing using a laser (also referred to as laser marking) as well as traditional printing using ink or dye for example by direct to card printing using a thermal printhead, inkjet printing, retransfer printing, or other printing techniques known in the art.

Figure 3:
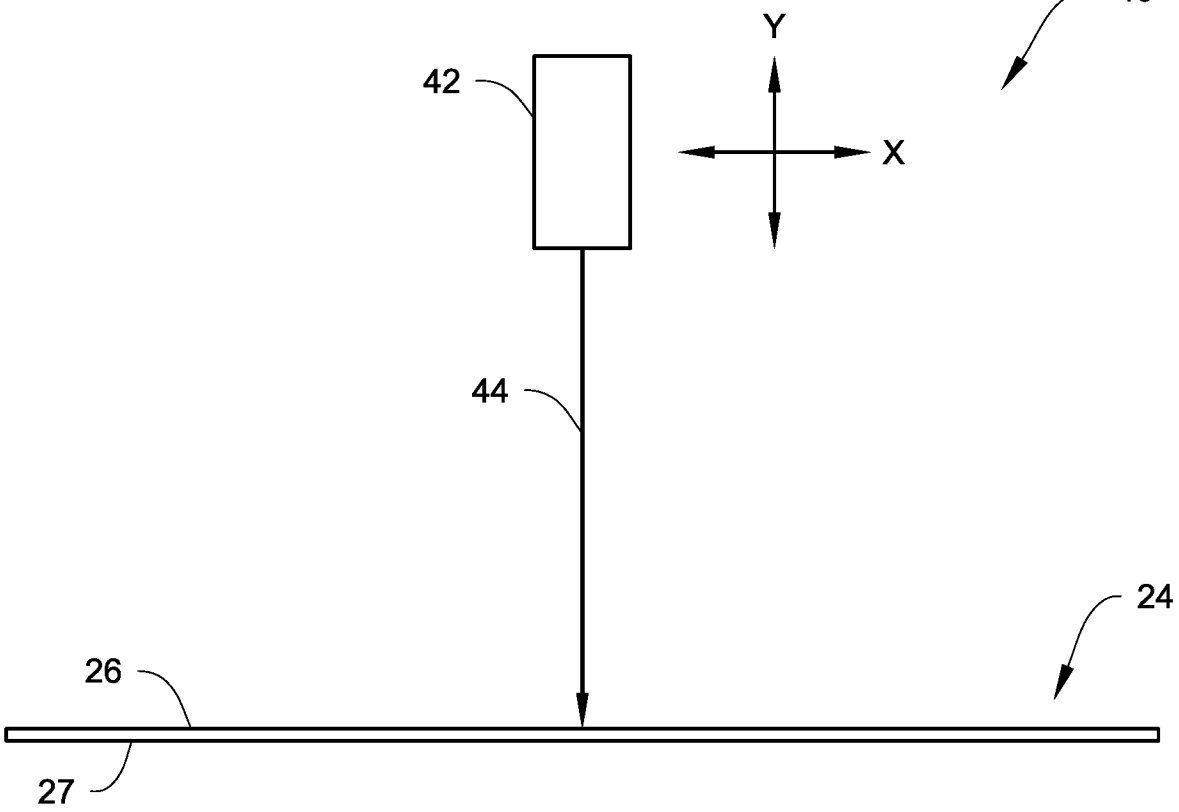
FIG. 3 illustrates an example of a laser system that can be used to laser mark the plastic security document.

FIG. 3 illustrates an example of a laser system 40 that can be used to laser mark the card 24. The laser system 40 is conventional in construction and operation and includes a laser 42 that generates a laser beam 44. The laser 42 is actuatable in X-Y directions as indicated by the arrows. The beam 44 can be delivered through an f-Theta focusing lens (not visible), though the f-Theta focusing lens is not present in all laser systems. At the center point of the focusing lens, the laser beam 44 has a 90 degree angle relative to the surface 26. As the laser beam 44 moves away from this center point, there will be a change to the angle relative to the surface 26.

The laser marking described herein can occur in any suitable plastic card processing system. One example of a suitable plastic card processing system is referred to as a central issuance card processing system that is typically designed for large volume batch processing of plastic cards, often employing multiple processing stations or modules to process multiple plastic cards at the same time to reduce the overall per card processing time. Examples of central issuance card processing systems include the MX and MPR family of central issuance systems available from Entrust Datacard Corporation of Shakopee, Minn. Other examples of central issuance systems are disclosed in U.S. Pat. Nos. 4,825,054, 5,266,781, 6,783,067, and 6,902,107, all of which are incorporated herein by reference in their entirety.

Another example of a suitable plastic card printing system that can be used is referred to as a desktop card processing system that is typically designed for relatively small scale, individual plastic card processing. In desktop processing systems, a single plastic card to be processed is input into the system, processed, and then output. These systems are often termed desktop machines or desktop printers because they have a relatively small footprint intended to permit the machine to reside on a desktop. Many examples of desktop machines are known, such as the SD or CD family of desktop card machines available from Entrust Datacard Corporation of Shakopee, Minn. Other examples of desktop card machines are disclosed in U.S. Pat. Nos. 7,434,728 and 7,398,972, each of which is incorporated herein by reference in its entirety.

Figure 4:
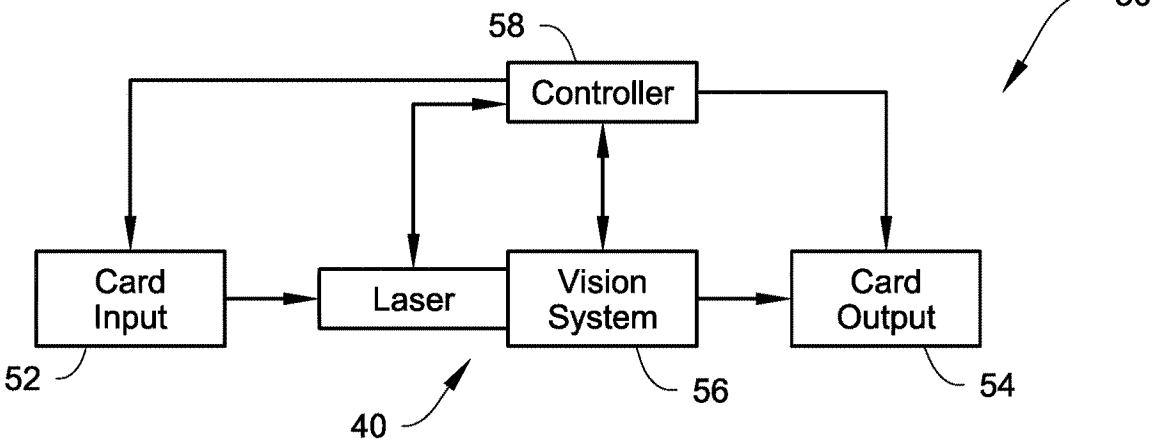
FIG. 4 illustrates an example of a plastic security document personalization system in which the techniques described herein can be implemented.

FIG. 4 illustrates an example of a card processing system 50 in which the laser system 40 can be incorporated. In this example, the system 50 includes a card input 52, a card output 54, a vision system 56, and a system controller 58. The card input 52 is configured to hold a plurality of plastic cards waiting to be laser marked, with the cards being fed one-by-one from the card input 52 into the system 50. The cards are transported downstream to the laser system 40 for laser marking. The vision system 56, which may be separate from the laser system 40 or incorporated/integrated with the laser system 40, is used to determine proper registration of the card in the laser system prior to laser marking or to check the quality of the resulting laser marking. Properly laser marked cards can then be transported to and collected in the card output 54, while improperly laser marked cards can be transported to a reject bin (not shown). The system controller 58 controls the operation of the laser system 40, the card input 52, the card output 54, and the vision system 56.

Figure 5:
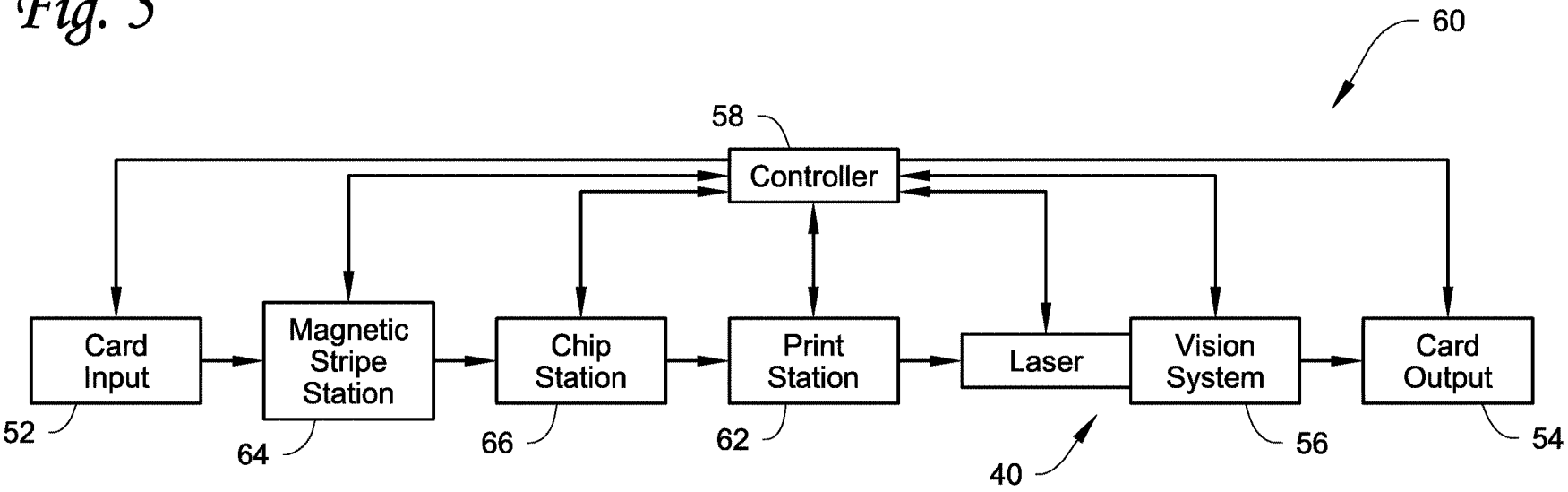
FIG. 5 illustrates another example of a plastic security document personalization system in which the techniques described herein can be implemented.

FIG. 5 illustrates another example of a card processing system 60 in which the laser system 40 can be incorporated. In this example, the system 60 includes the card input 52, the card output 54, the vision system 56, and the system controller 58. The system 60 further includes additional card processing elements such as a print station 62, and optionally a magnetic stripe station 64, and/or an integrated circuit chip station 66.

The print station 62 is configured to perform traditional printing on the card 24 prior to the laser marking by the laser system 40. The printing performed by the print station 62 can print using ink or dye for example direct to card printing using a thermal printhead and print ribbon, inkjet printing, retransfer printing, or other printing techniques known in the art.

The magnetic stripe station 64 is optional. If present, the magnetic stripe station 64 can verify the operation of the magnetic stripe 36 on the back surface 27 of the card 24 and/or program the magnetic stripe 36 with data. An example of a magnetic stripe station is described in U.S. Pat. No. 6,902,107 which is incorporated herein by reference in its entirety.

The integrated circuit chip station 66 is also optional, and if present, is designed to verify the operation of the chip 38 on the card 24 and/or program the chip 38 with data. The chip station 66 can include a single chip programming station for programming a single card at a time within the station 66, or the station 66 can be configured to simultaneously program multiple cards. A chip station having simultaneous, multiple card programming is described in U.S. Pat. No. 6,695,205 (linear cassette configuration) and in U.S. Pat. No. 5,943,238 (barrel configuration) each of which is incorporated herein by reference in its entirety.

Transport of the cards within and through the systems 50, 60 is performed using one or more transport systems that are well known in the art. The transport system(s) can have any construction suitable for transporting the card 24. Many examples of transport systems that could be used are well known in the art. Examples of card transport systems that can be used include, but are not limited to, rollers, belts (with tabs or without tabs), carriage(s), any combinations thereof, and the like. The construction and operation of card transport systems for transporting cards between a card input, a card output, and card processing stations between the card input and the card output are well known in the art.

Figure 6A:
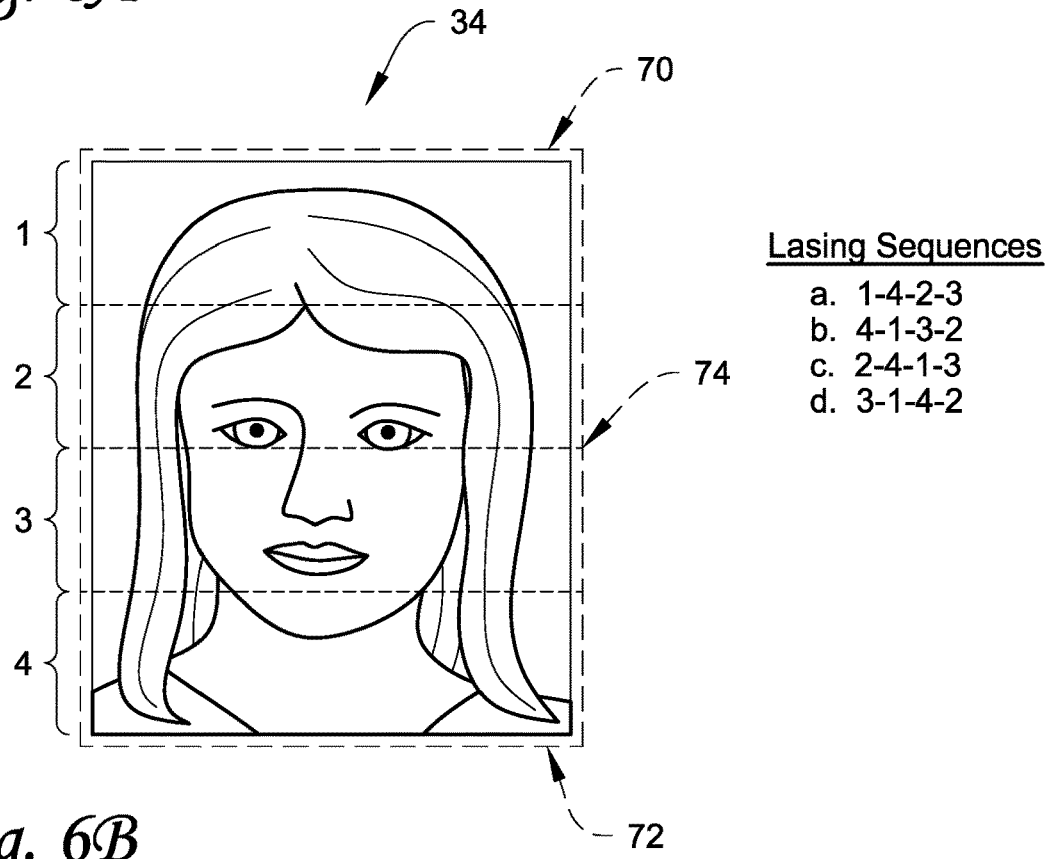
FIGS. 6A and 6B illustrate examples of a technique for mitigating warpage on the document while laser marking the image on the document.
Figure 6B:
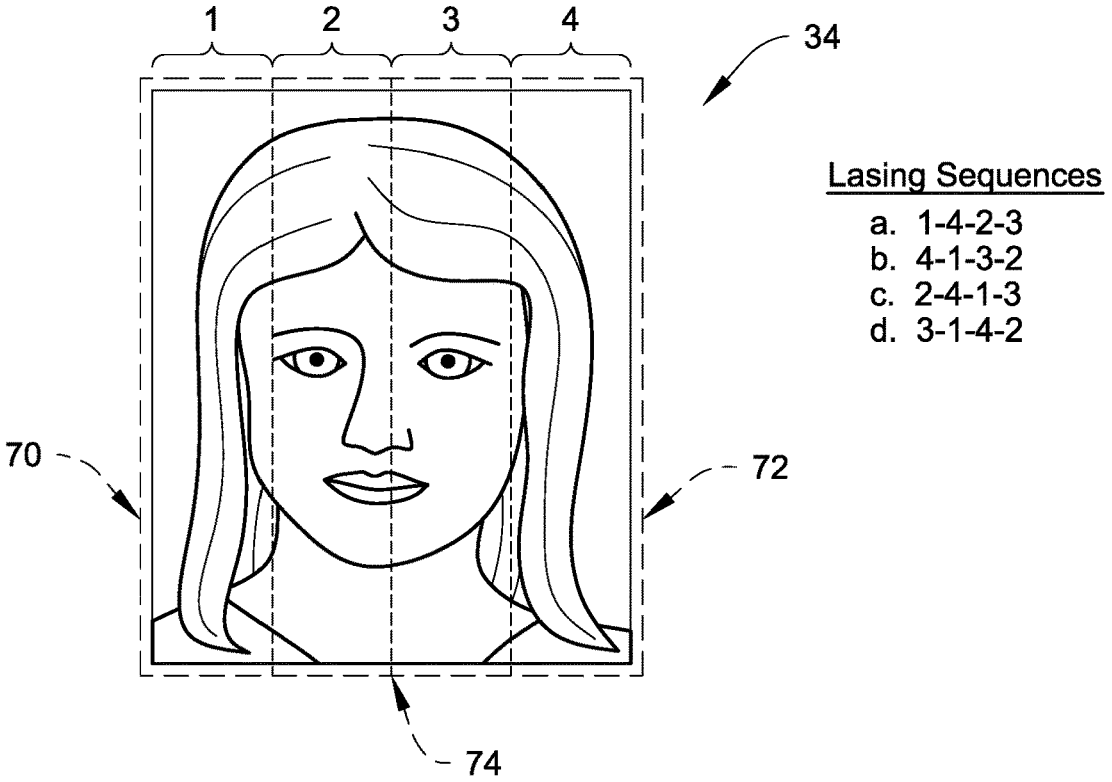

FIGS. 6A and 6B illustrate examples of a technique for mitigating warpage on the document surface (front surface 26 or back surface 27) while laser marking to form the image 34 on the document surface 26 or 27. For illustration, the image 34 is a portrait image. It is to be appreciated that the technique for mitigating warpage in FIGS. 6A and 6B is not limited to portrait images only, but can be applied to any laser marking on the surface of the document where the laser marking needs to be precisely aligned or registered with printed material (for example, pre-printed material or previously laser marked portions during the laser marking process described herein) present on the surface of the document.

In one embodiment, the image 34 is electronically divided into four sections 1-4 by a controller, such as the controller 58. The image 34 is electronically divided prior to laser marking on the document surface 26 or 27. That is, electronically dividing the image 34 is a form of processing the image 34 prior to laser marking. Accordingly, the image 34 in FIGS. 6A and 6B including the dashed lines is a physical representation of the electronic division of the image 34 that is to be formed on the document surface 26 or 27 for illustrative purposes. The image 34, when laser marked, does not include the dividing lines on the document surface 26, 27. The four sections 1-4 represent portions of the image 34 that is to be laser marked. Borders of the sections 1-4 are shown in dashed lines. The number of sections is an example and fewer or additional sections can be included. For example, FIG. 7 illustrates an example in which eight sections 1-8 are included. The number of sections can be selected based on a balancing between mitigating warpage and a total time required for marking the card 24. The number of sections can also be selected based on a size of the image 34. The number of sections is not limited to an even number of sections, and can include an odd number of sections in an example. The sizes of the sections 1-4 are also representative and are generally based on a size of the image 34. The sizes of the sections can be equal to one another, some of the section sizes can vary from other section sizes, or all of the sections can vary in size from one another.

Example lasing sequences are listed. One example lasing sequence includes laser marking the sections in the following sequence: section 1, section 4, section 2, and then section 3. A second lasing sequence begins at a different section than the first lasing sequence. A second possible lasing sequence includes laser marking section 4, section 1, section 3, and then section 2. Additional possible sequences in FIGS. 6A and 6B include, but are not limited to: section 2, section 4, section 1, and finally section 3; or section 3, section 1, section 4, and finally section 2. To mitigate warpage, the ordering of the lasing sequence is such that non-contiguous or non-adjacent sections (i.e., spaced from each other) are sequentially marked.

In another example, a number of sections of the image may be two. In such an example, the sections may be adjacent and sequentially marked. A time delay can be added between the laser marking of one or more of the sections. A suitable time delay may be at or about 10 seconds. In another example, the time delay can be less than 10 seconds, and in further embodiments the time delay can be less than 5 seconds. Generally, the laser is applied from a terminal edge 70 or 72 of the image 34 toward a center 74 of the image 34. Moving from the center 74 outwardly toward the terminal edges 70, 72 can also be performed, though may provide relatively less warpage mitigation than moving from the terminal edges 70, 72 toward the center 74.

In FIG. 6A, the sections 1-4 are shown as horizontally dividing the image 34 into rows. It is to be appreciated that the sections 1-4 can alternatively be formed vertically with respect to the image 34 so that the image 34 is divided into four columns (FIG. 6B). The orientation of the sections 1-4 described is relative to the image 34 being formed, and can vary with respect to the orientation of the card 24. That is, the sections 1-4 may be horizontally divided relative to the image 34, but vertically divided relative to the card 24, depending upon the orientation of the card 24.

Figure 7A:
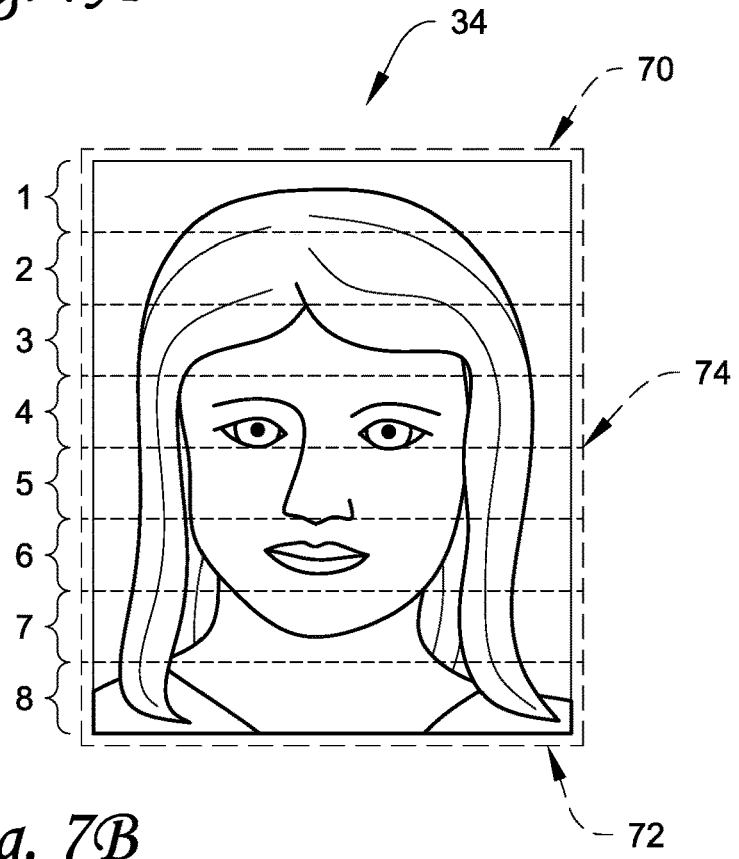
FIGS. 7A and 7B illustrate other examples of a technique for mitigating warpage on the document while laser marking the image on the document.
Figure 7B:
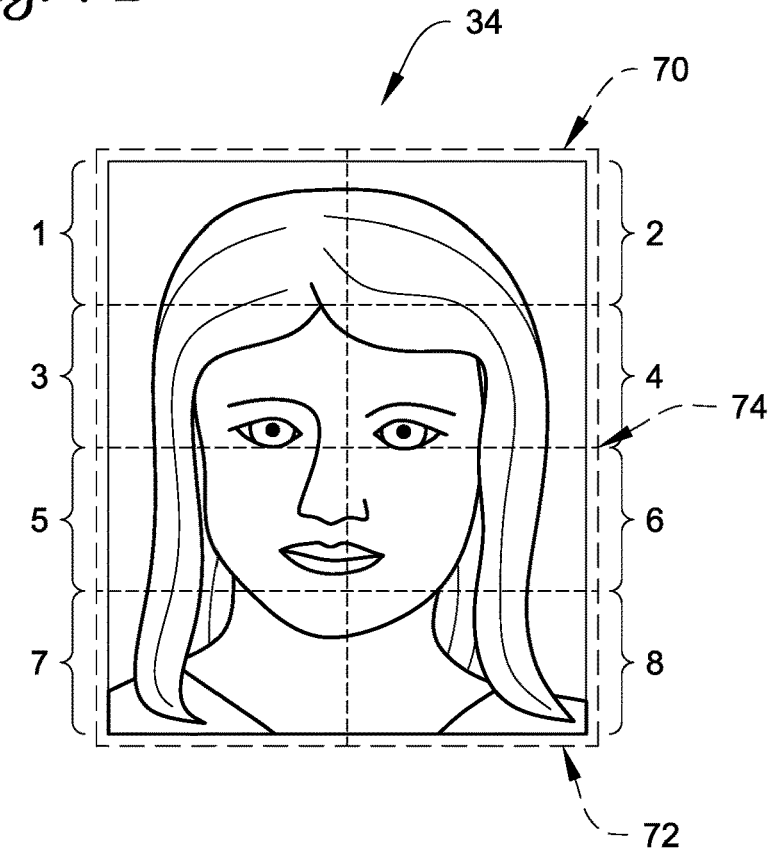

FIGS. 7A and 7B illustrate other examples of a technique for mitigating warpage on the document surface (the front surface 26 or the back surface 27) while laser marking the image 34 on the document surface 26 or 27. For illustration, the image 34 is selected. It is to be appreciated that the technique for mitigating warpage in FIGS. 7A and 7B is not limited to portrait images, such as the image 34, only, but can be applied to any laser marking on the surface of the document.

In one embodiment, the image 34 is electronically divided into eight sections 1-8 by a controller, such as the controller 58. The image 34 is electronically divided prior to laser marking on the document surface 26 or 27. That is, electronically dividing the image 34 is a form of processing the image 34 prior to laser marking. Accordingly, the image 34 in FIGS. 7A and 7B including the dashed lines is a physical representation of the electronic division of the image 34 that is to be formed on the document surface 26 or 27 for illustrative purposes. The image 34, when laser marked, does not include the dividing lines on the document surface 26 or 27. The eight sections 1-8 represent a portion of the image 34 that is to be laser marked. The number of sections is an example and fewer (e.g., FIGS. 6A, 6B) or additional sections can be included. The number of sections can be selected based on a balancing between mitigating warpage and a total time required for marking the card 24. The sizes of the sections 1-8 are also representative and are generally based on a size of the image 34. The sizes of the sections can be equal to one another, some of the section sizes can vary from other section sizes, or all of the sections can vary in size from one another.

Example lasing sequences are shown. A first example lasing sequence includes laser marking section 1, section 8, section 2, section 7, section 3, section 6, section 4, and then section 5. A starting point of a second lasing sequence is opposite relative to the first lasing sequence. The second lasing sequence includes laser marking section 8, section 1, section 7, section 2, section 6, section 3, section 5, and then section 4. To mitigate warpage, the ordering of the lasing sequence is such that non-contiguous or non-adjacent sections (i.e., spaced from each other) are sequentially marked until an end of the process in which contiguous or adjacent segments remain.

In another example, a number of sections may be two. In such an example, the sections may be adjacent and sequentially marked. A time delay can be added between the laser marking of one or more of the sections. Generally, the laser marking is performed from the terminal edges 70 or 72 of the image 34 toward the center 74 of the image 34. Moving from the center 74 outwardly toward the terminal edges 70, 72 can also be performed, though may provide relatively less warpage mitigation than moving from the terminal edges 70, 72 toward the center 74.

In the illustrated example, the sections 1-8 are shown as horizontally dividing the image 34 into rows. It is to be appreciated that the sections 1-8 can alternatively be formed vertically with respect to the image 34 so that the image 34 is divided into eight columns (not shown). In another example, as shown in FIG. 7B, the image 34 can be divided into both columns and rows. Example lasing sequences are shown in FIG. 7B. The orientation of the sections 1-8 is relative to the image 34 being lased, and can vary with respect to the orientation of the card 24. That is, the sections 1-8 may be horizontally divided relative to the image 34, but vertically divided relative to the card 24, depending on the orientation of the card 24.

Figure 8:
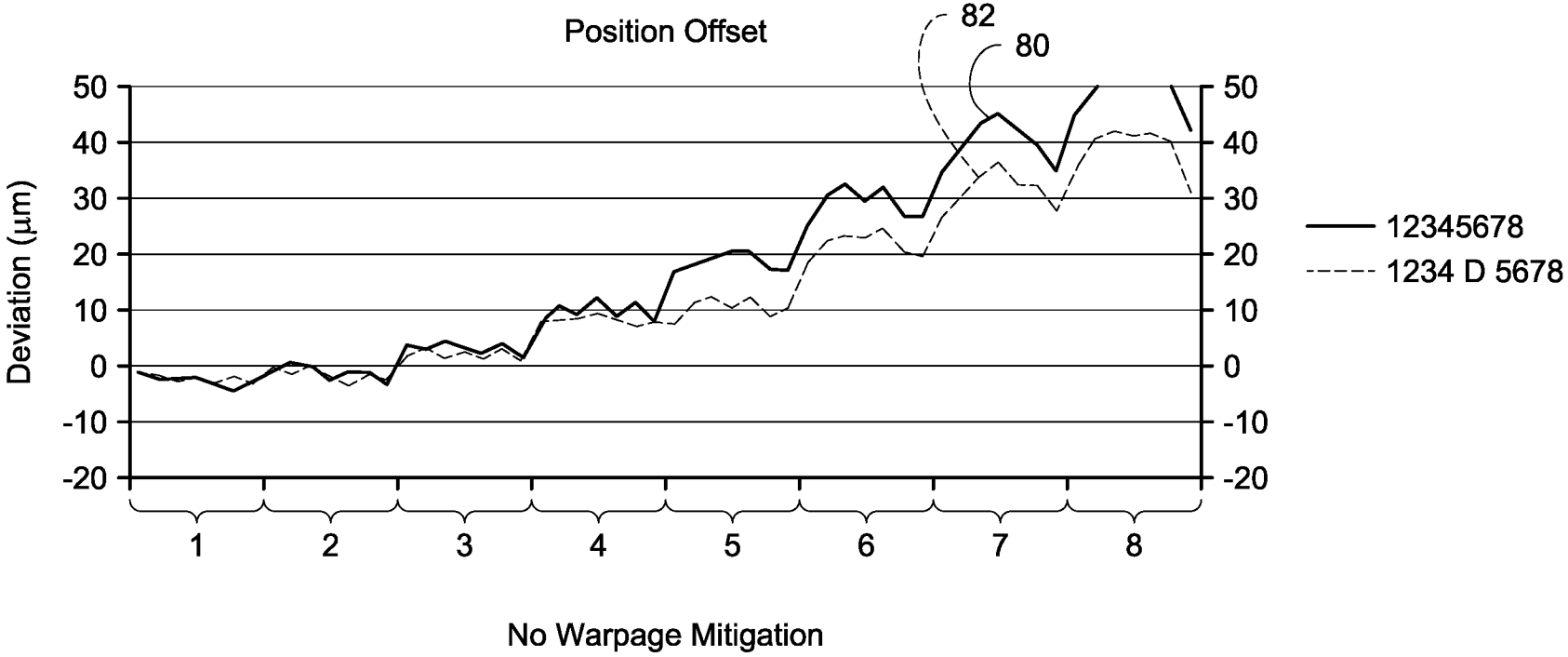
FIG. 8 illustrates an example of positional offsets of subsequent laser markings that can occur as a result of no warpage mitigation being applied and when a time delay is applied.

FIG. 8 illustrates an example of positional offsets of subsequent laser markings that can occur as a result of no warpage mitigation being applied. In the illustrated figure, two lasing sequences 80, 82 are shown. The lasing sequences 80, 82 assume that the portrait image 34 is divided into eight sections, as in the example of FIG. 7A. The first lasing sequence 80 is sequentially from 1-8 (i.e., section 1, section 2, section 3, section 4, section 5, section 6, section 7, section 8). The second lasing sequence 82 is sequential from 1-8, with a delay between sections 4 and 5 so that the sequence is sections 1-4, a delay, then sections 5-8. The vertical axis shows the deviation position (in μm) against the lasing sequence along the horizontal axis. The deviation position begins to increase at about laser marking of section 3 as the heat energy from the laser continues to increase. In both lasing sequences 80, 82, the position deviation is greater than 40 μm before the lasing sequence is completed.

Figure 9:
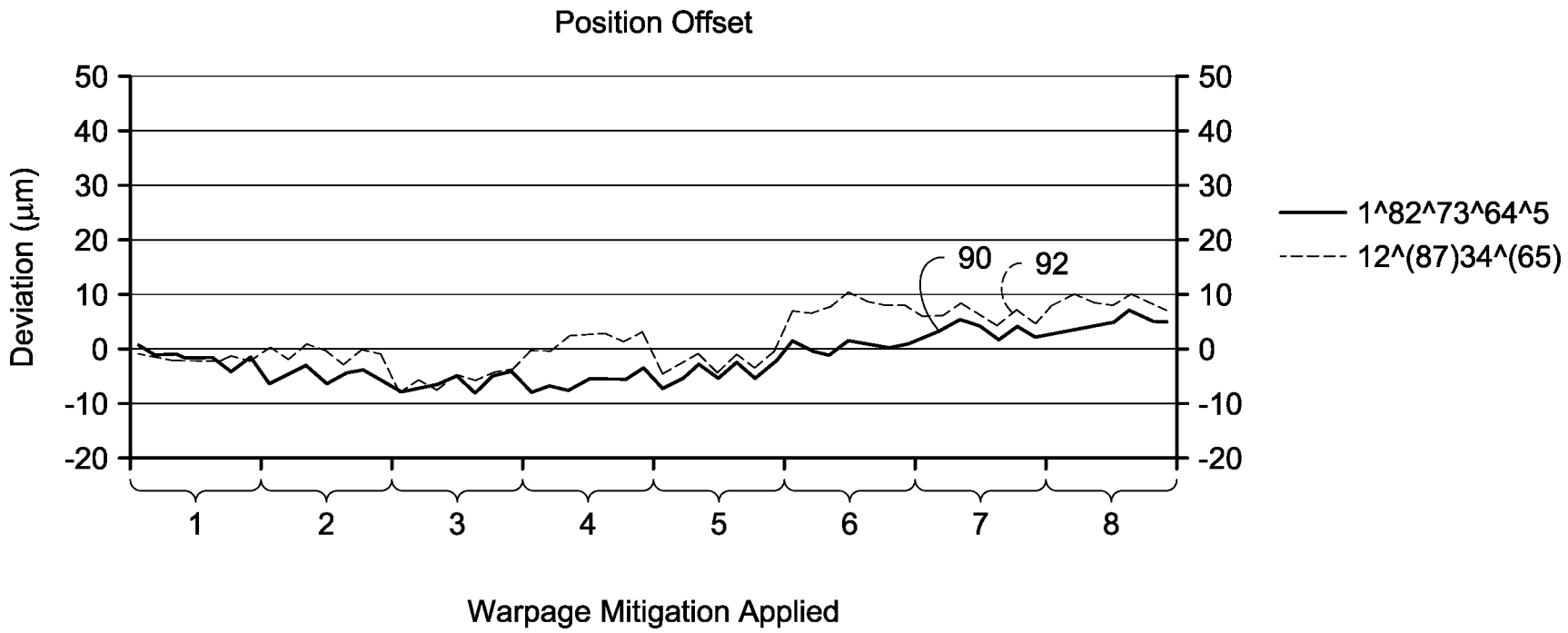
FIG. 9 illustrates an example of positional offsets of subsequent laser markings that can occur as a result of warpage mitigation being applied.

FIG. 9 illustrates an example of positional offsets of subsequent laser markings that can occur as a result of warpage mitigation described herein being applied. In the illustrated figure, two lasing sequences 90, 92 are shown. The lasing sequences 90, 92 assume that the portrait image 34 is divided into eight sections, as in the example of FIG. 7A. The lasing sequence 92 includes laser marking of contiguous sections, effectively resulting in the image 34 being divided into four sections, as in the example of FIG. 6. The vertical axis shows the deviation position (in μm) against the lasing sequence along the horizontal axis. The deviation position is more gradual than that shown in FIG. 8. In both lasing sequences 90, 92, the position deviation remains within about 10 μm during the lasing sequence. Thus the warpage mitigation can result in a significant reduction relative to the lasing sequences 80, 82 in FIG. 8. The warpage mitigation can result in about 5 times less deviation than when no warpage mitigation is applied. An amount of reduction in position deviation (i.e., an effectiveness of the warpage mitigation) may depend on a size of the image 34. For example, applying warpage mitigation as described herein may be more effective at reducing an amount of position deviation as a size of the image 34 increases.

FIGS. 10A-F illustrate an example sequence of a method 100 of laser marking a feature onto the document surface (e.g., the front surface 26 or the back surface 27). The feature can be the image 34 as shown and described above. Alternatively, the feature can be another laser marking such as a symbol, design, or the like. The method 100 generally includes laser marking a first portion of the feature onto the surface and laser marking a second portion that is not contiguous with the first portion of the feature onto the surface. The method 100 can register the lased areas of the feature with previously applied components of a single feature. The method 100 can mitigate warpage, thereby improving registration.

Figure 10A:
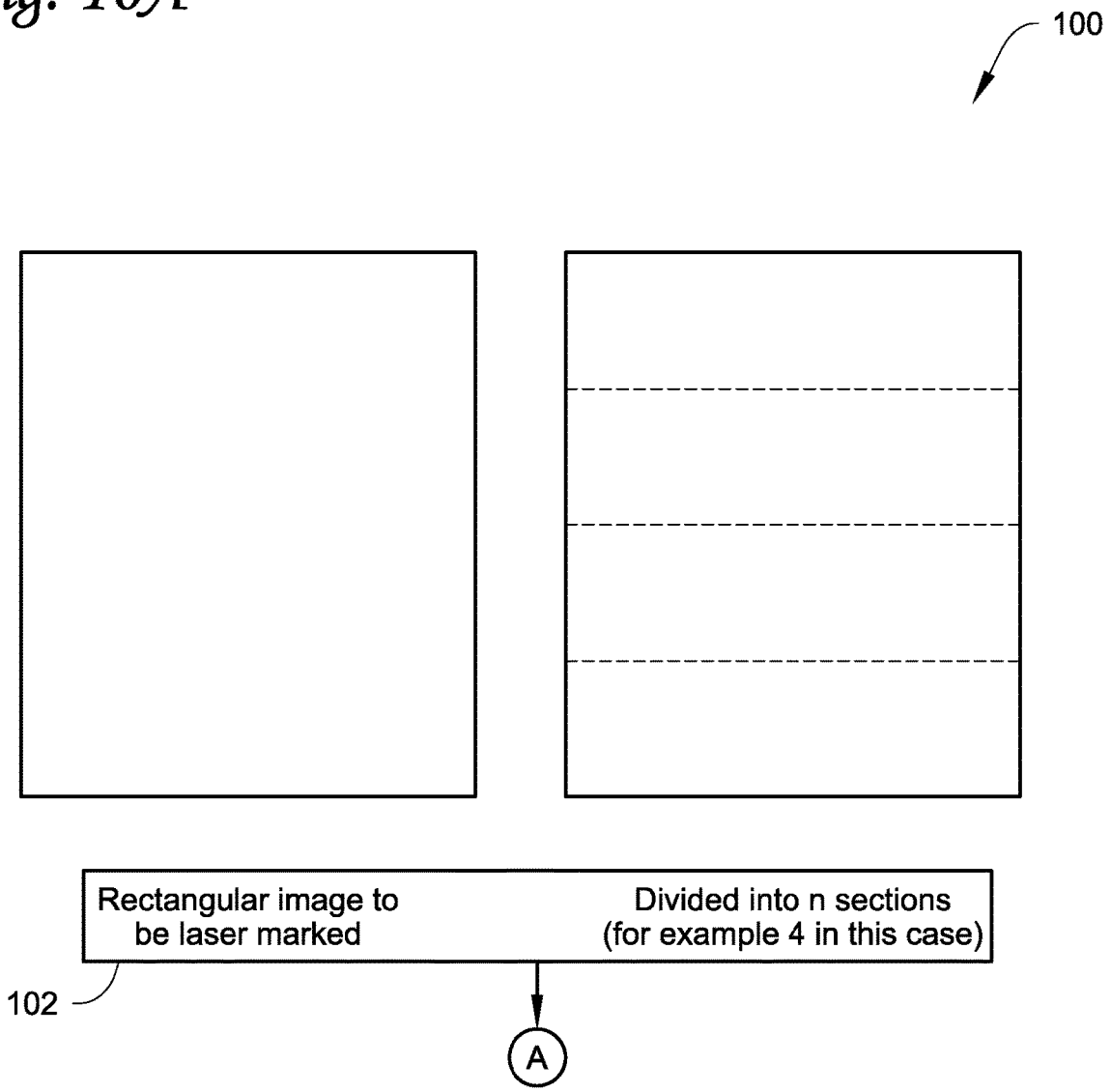

At 102, the feature is electronically divided into a plurality of sections or portions prior to laser marking by the laser system 40 (FIG. 10A). Examples of the electronic division of the feature are shown and described above regarding FIGS. 6A, 6B, 7A, and 7B. The electronic division of the feature can be completed by the controller 58 of the system 50 or the system 60. In the illustrated figure, four sections are shown for purposes of this example. As discussed above, the number of sections is not limited to four. The electronically divided sections can be stored in a memory of the controller 58 for providing instructions to the laser system 40 for laser marking the feature onto the card 24.

Figure 10B:
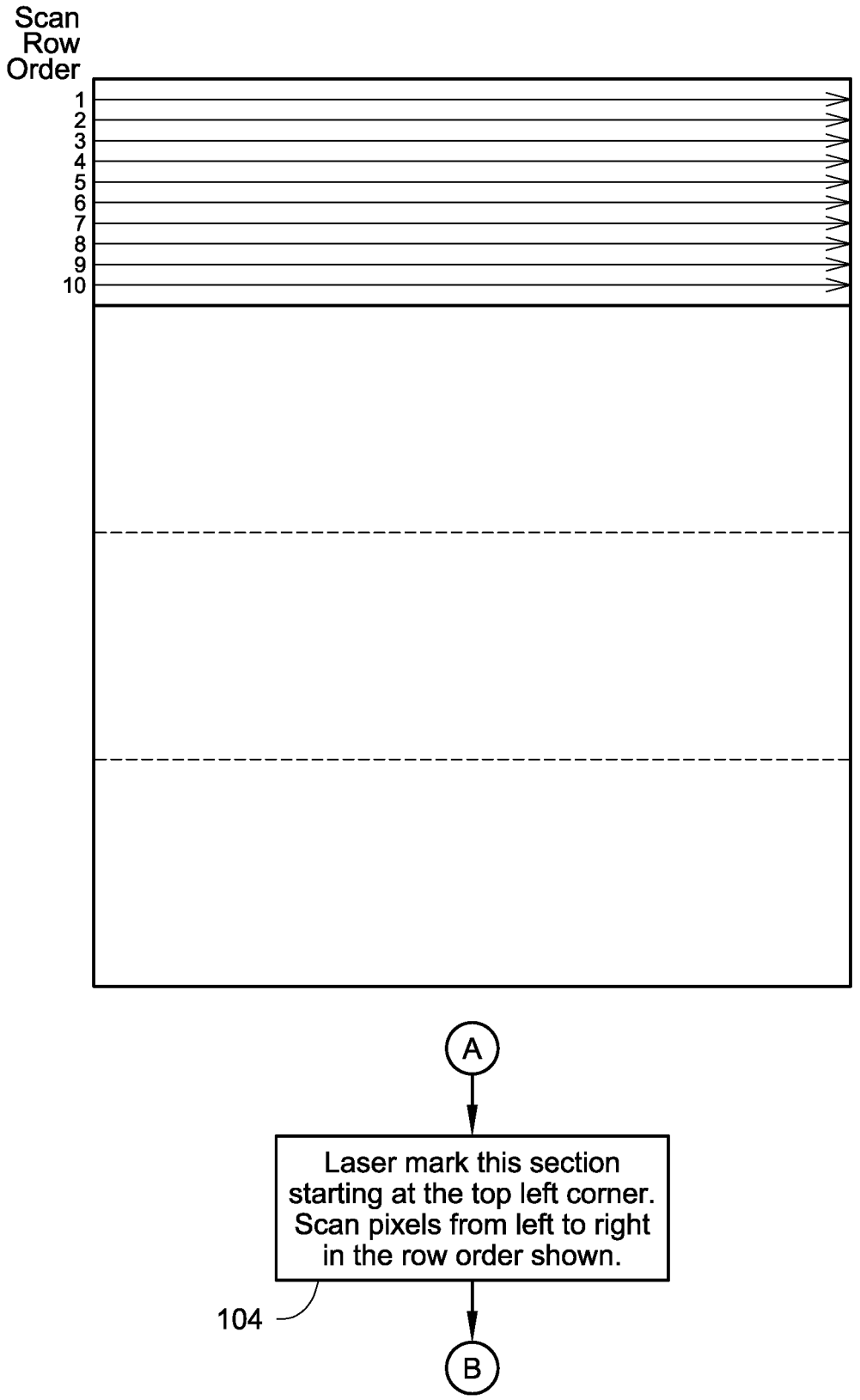

At 104 a first section is laser marked by the laser system 40 (FIG. 10B). The first section can include one or a plurality of rows to be laser marked by the laser system 40. The first section can be disposed at a first terminal edge of the feature. The first terminal edge can be representative of a longitudinal edge or a lateral edge of the feature. The plurality of rows in the first section are lased in a direction that is from the first terminal edge of the feature toward the center of the feature. The plurality of rows may not include continuously marked areas, but rather may include marking overlapped with (i.e., registered) a portion of the feature that was previously printed on the card.

Figure 10C:
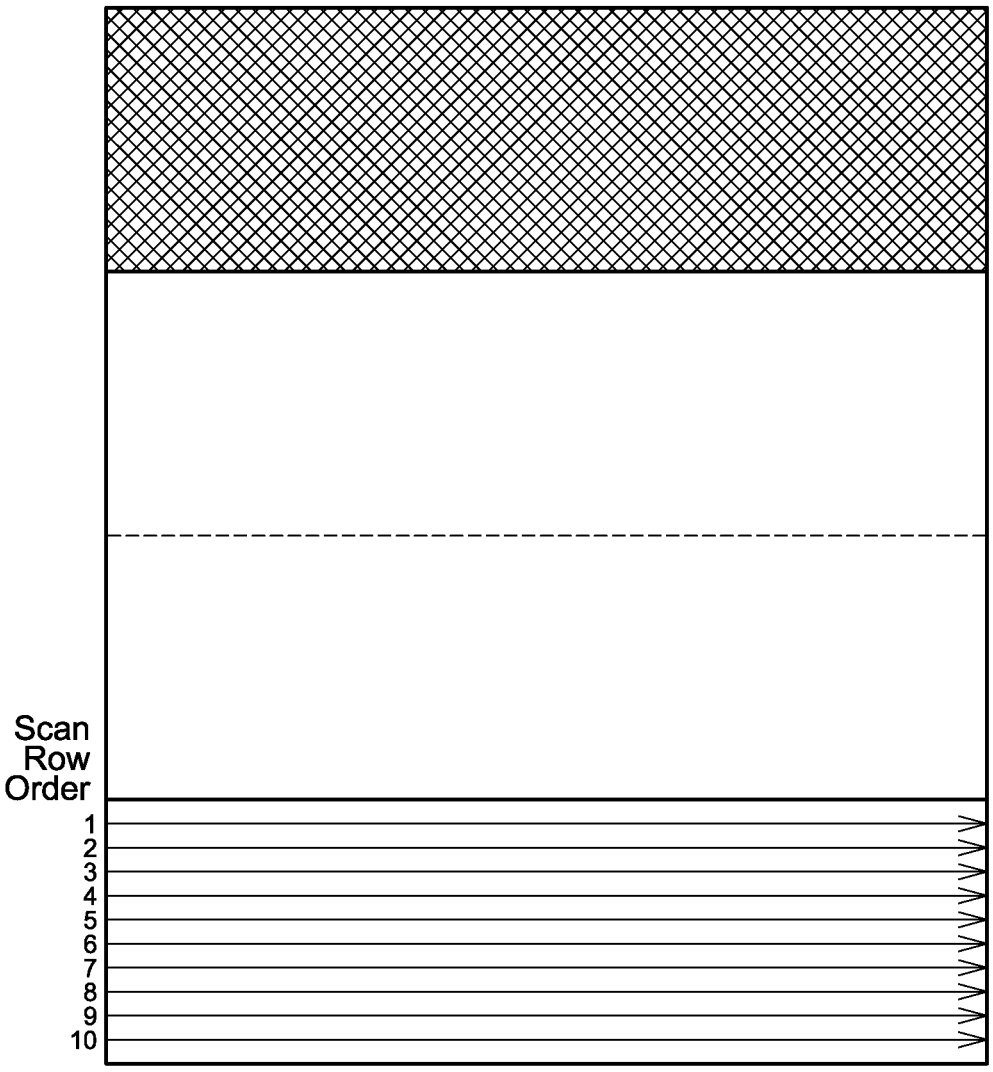
Figure 10C:
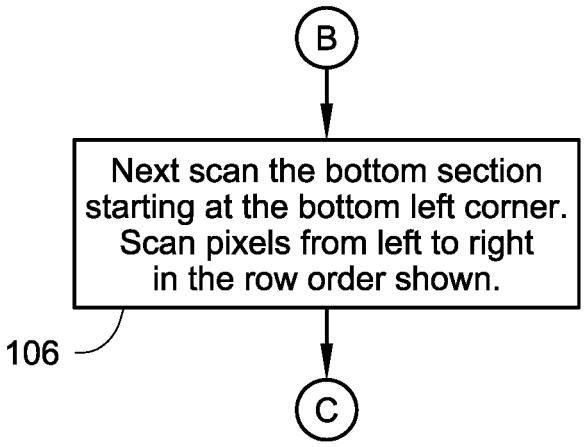

At 106 a second section is laser marked by the laser system 40 (FIG. 10C). The second section may not be contiguous or not adjacent to the first section, depending upon a number of sections in the feature. The second section can include one or a plurality of rows to be laser marked by the laser system 40. The second section can be disposed at a second terminal edge of the feature that is opposite the first terminal edge. The second terminal edge can be representative of a longitudinal edge or a lateral edge of the feature. The plurality of rows in the second section are lased in a direction that is from the second terminal edge of the feature toward the center of the feature. The direction at 106 can be different (e.g., opposite) than the direction at 104. The plurality of rows may not include continuously marked areas, but rather may include marking overlapped with (i.e., registered) a portion of the feature that was previously printed on the card. In an example, the feature may be electronically divided into two sections. In such an example, the method 100 ends before 108 or 110.

Figure 10D:
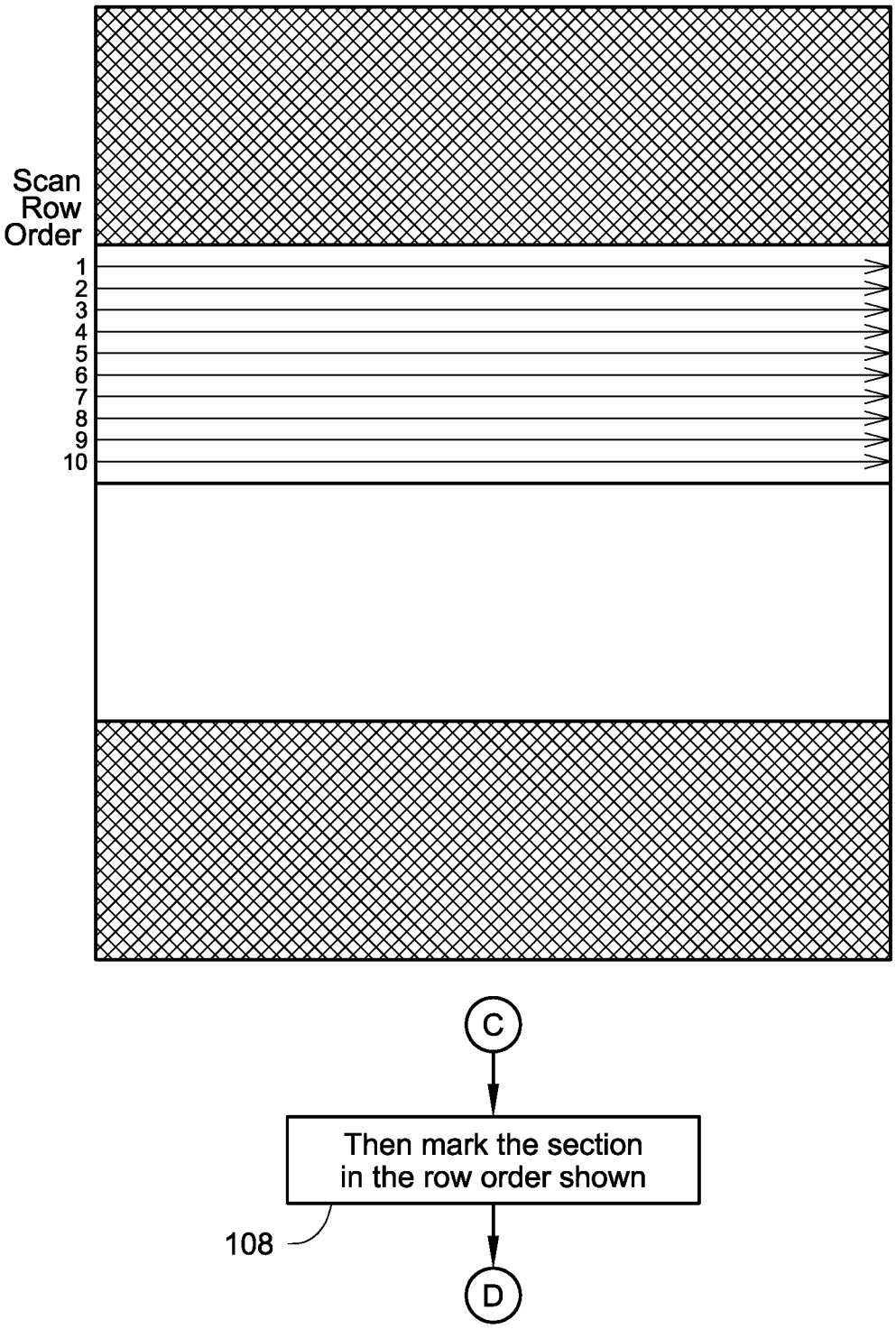

At 108 a third section is laser marked by the laser system 40 (FIG. 10D). The third section is contiguous or adjacent to the first section that is generated at 104. It is to be appreciated that the number of sections may determine the location of the third section. The third section can include one or a plurality of rows to be laser marked by the laser system 40. The plurality of rows in the third section are lased in a direction that is from the first terminal edge of the feature toward the center of the feature. That is, the direction at 108 can be the same as the direction at 104. The plurality of rows may not include continuously marked areas, but rather may include marking overlapped with (i.e., registered) a portion of the feature that was previously printed on the card.

Figure 10E:
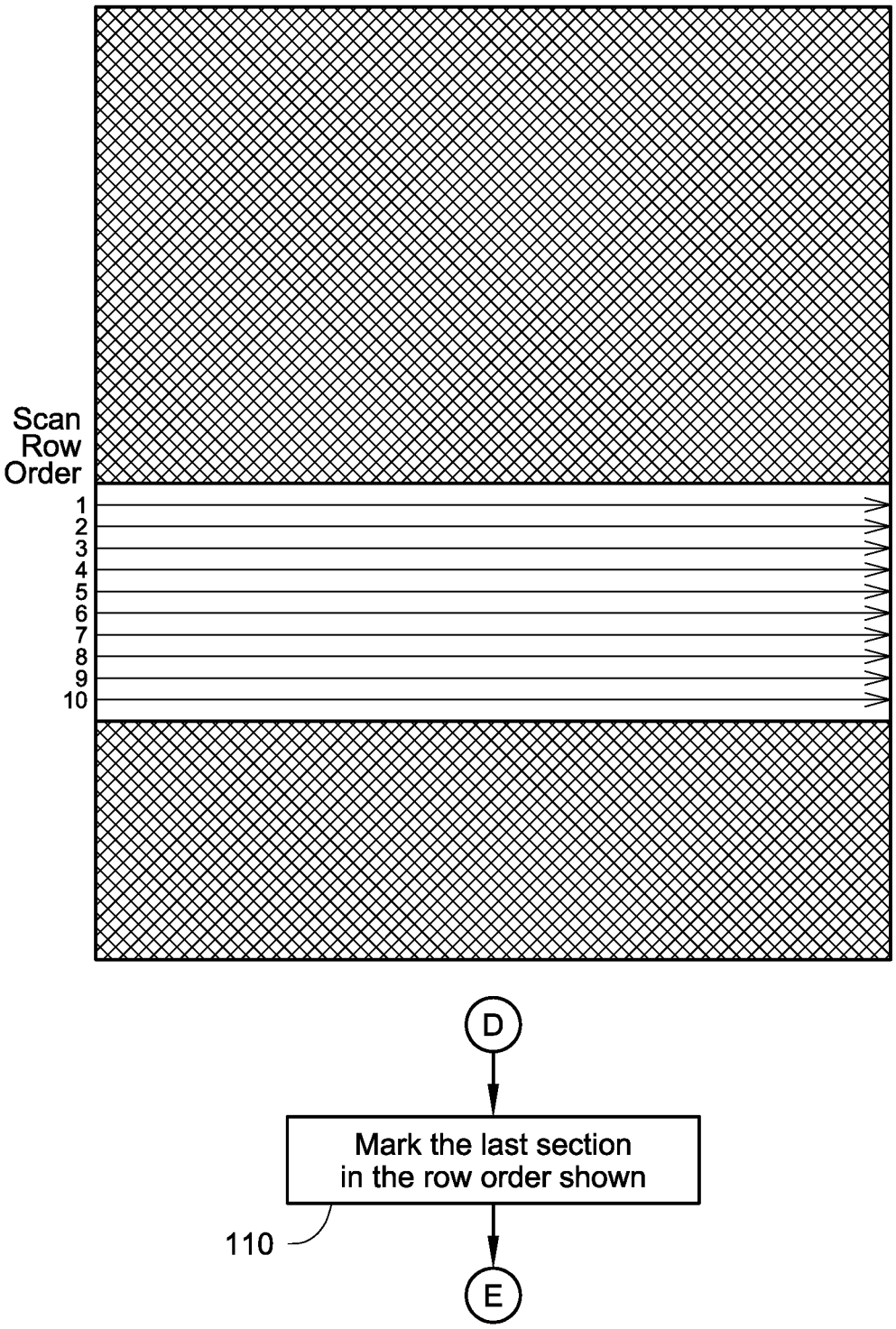
Figure 10F:
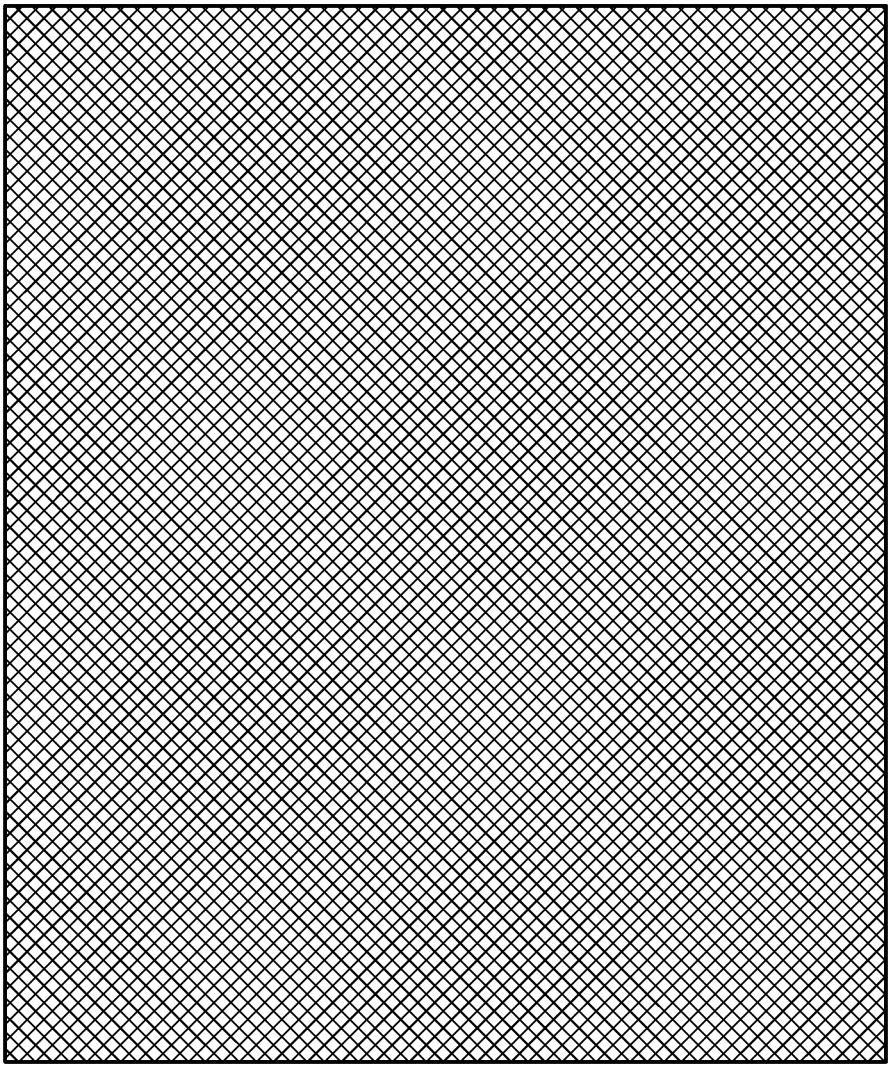

At 110 a fourth section is laser marked by the laser system 40 (FIG. 10E). The fourth section is contiguous or adjacent to the second section that is generated at 106. It is to be appreciated that the number of sections may determine the location of the fourth section. The fourth section can include a plurality of rows to be laser marked by the laser system 40. The plurality of rows in the fourth section are lased in a direction that is from the second terminal edge of the feature toward the center of the feature. That is, the direction at 110 can be the same as the direction at 106. The number of sections will also determine how many steps are in the lasing sequence. As the electronic division of the feature at 102 was into four sections in this example, following the laser marking of the fourth section at 110, the feature is completed (FIG. 10F). The plurality of rows may not include continuously marked areas, but rather may include marking overlapped with (i.e., registered) a portion of the feature that was previously printed on the card.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of laser marking a feature onto a plastic card, the method comprising:

dividing the feature into a plurality of portions including a first portion and a second portion;

laser marking the first portion of the feature onto the plastic card by causing a darkening of a material of the plastic card using a laser beam;

laser marking the second portion of the feature onto the plastic card by causing a darkening of the material of the plastic card using a laser beam, wherein the first portion is not continuous with the second portion.

2. The method of claim 1, wherein the plurality of portions further includes a third portion, and further comprising laser marking the third portion of the feature onto the plastic card by causing a darkening of the material of the plastic card using a laser beam, the third portion being continuous with the first portion.

3. The method of claim 1, wherein the feature is a facial image.

4. The method of claim 1, wherein the first portion is at a first terminal edge of the feature, and the second portion is at a second terminal edge of the feature opposite the first terminal edge.

5. The method of claim 4, wherein the first terminal edge is a first longitudinal edge or a first lateral edge, and the second terminal edge is a second longitudinal edge or a second lateral edge.

6. The method of claim 1, wherein the plastic card includes an element applied to the plastic card prior to the laser marking of the first portion and of the second portion, and the laser marking of the first portion and the laser marking of the second portion are registered with the element.

7. The method of claim 6, wherein the element is printed on the plastic card.

8. The method of claim 1, wherein laser marking the first portion on the plastic card includes laser marking in a first direction, and laser marking the second portion on the plastic card includes laser marking in a second direction.

9. The method of claim 8, wherein the first direction is opposite the second direction.

10. The method of claim 1, wherein the plurality of portions includes at least two portions in addition to the first portion and the second portion.

11. The method of claim 1, wherein the plurality of portions includes six portions in addition to the first portion and second portion.

12. The method of claim 1, wherein dividing the feature into a plurality of portions includes dividing the feature into a plurality of rows.

13. The method of claim 1, wherein dividing the feature into a plurality of portions includes dividing the feature into a plurality of columns.

14. The method of claim 1, wherein the plurality of portions have a uniform size.

15. A method of laser marking a feature onto a plastic card, the method comprising:

laser marking a first portion of the feature onto the plastic card by causing a darkening of a material of the plastic card using a laser beam;

laser marking a second portion of the feature onto the plastic card by causing a darkening of the material of the plastic card using a laser beam, wherein the first portion is not continuous with the second portion, and providing a time delay between laser marking the first portion and laser marking the second portion.

16. A plastic card processing system, comprising:

a card input that is configured to hold a plurality of plastic cards to be laser marked;

a laser system downstream from the card input that is configured to laser mark the plurality of plastic cards by causing a darkening of a material of the plastic card;

a card output that collects plastic cards having been laser marked by the laser system;

a transport mechanism that transports the plurality of plastic cards from the card input, to the laser system, and to the card output; and a controller connected to the laser system and that controls operation of the laser system, the controller:

divides an image of a feature to be applied to one of the plurality of plastic cards into a plurality of portions;

controls the laser system to laser mark a first one of the portions on the one plastic card by causing a darkening of the material of the plastic card using a laser beam;

controls the laser system to laser mark a second one of the portions on the one plastic card by causing a darkening of the material of the plastic card using a laser beam, wherein the first portion is not continuous with the second portion.

17. The plastic card processing system of claim 16, further comprising a printing station that prints on the one plastic card.

18. The plastic card processing system of claim 16, wherein the one plastic card includes an element applied thereto prior to the laser marking of the first portion and of the second portion, and the first portion and the second portion are registered with the element.

19. A method of laser marking a feature onto a plastic card, the method comprising:

laser marking a first portion of the feature onto the plastic card in a first direction starting from a first terminal edge of the feature and moving toward a center of the feature and stopping short of a second terminal edge of the feature, wherein laser marking the first portion comprises causing a darkening of a material of the plastic card using a laser beam;

laser marking a second portion of the feature onto the plastic card in a second direction starting from the second terminal edge of the feature and moving toward the center of the feature, wherein laser marking the second portion comprises causing a darkening of the material of the plastic card using a laser beam.

20. The method of claim 19, wherein the first direction is opposite the second direction.

21. The method of claim 19, wherein the first direction is different than the second direction.

* * * * *